United States Patent [19]

Fromme

[11] Patent Number: 4,640,547

[45] Date of Patent: Feb. 3, 1987

[54] ADJUSTABLE SWIVEL CHAIR

[76] Inventor: Heinrich Fromme, 27, Liemker Strasse, D-4815 Schloss Holte, Fed. Rep. of Germany

[21] Appl. No.: 630,111

[22] Filed: Jul. 12, 1984

[30] Foreign Application Priority Data

Sep. 17, 1983 [DE] Fed. Rep. of Germany ... 8326792[U]

[51] Int. Cl.[4] ..... A47C 1/032

[52] U.S. Cl. ..... 297/301; 297/316; 297/320; 297/353; 297/354

[58] Field of Search ..... 297/354, 353, 355, 340, 297/316, 320, 298, 296, 300, 304, 306, 301

[56] References Cited

U.S. PATENT DOCUMENTS

| | | | |
|---|---|---|---|
| 2,093,319 | 9/1937 | Herold | 297/301 |
| 2,341,124 | 2/1944 | Sheldrick | 297/354 |
| 3,034,828 | 5/1962 | Kurihara | 297/304 |
| 3,602,537 | 8/1971 | Kerstholt | 297/304 |
| 3,635,525 | 1/1972 | Magyar | 297/354 |
| 3,837,705 | 9/1974 | Marvaccini | 297/353 |
| 3,989,297 | 11/1976 | Kerstholt | 297/300 |

FOREIGN PATENT DOCUMENTS

| | | | |
|---|---|---|---|
| 1324973 | 3/1963 | France | 297/353 |
| WO80/01534 | 8/1980 | PCT Int'l Appl. | 297/316 |
| 121416 | 4/1948 | Sweden | 297/304 |

*Primary Examiner*—Kenneth J. Dorner
*Assistant Examiner*—Mark W. Binder
*Attorney, Agent, or Firm*—Burns, Doane, Swecker & Mathis

[57] ABSTRACT

The present invention relates to an adjustable swivel chair with a pivoting angular holder for the backrest. The angular holder for the backrest is provided into an upper portion and an offset arm so as to allow for the articulated movement of the parts with respect to one another. The offset arm extends under the seating surface while the upper portion provides a support for the backrest. Adjustment means are provided in the form of frictional engagement of lamellar packs and the clamping thereof by means of a clamping adjustment device which may be released so as to position the movable elements with respect to one another. The assembly is mounted on a support post and the upper external portion of the support element defines the seat portion of the swivel chair.

12 Claims, 8 Drawing Figures

ADJUSTABLE SWIVEL CHAIR

This invention relates to a chair, in particular a swivel chair with a pivoting angular holder for the backrest. The backrest holder is articulatedly mounted under the seating surface.

In prior art chairs of this type, holders mounted under the seating surface in an articulated manner require a relatively large space and consequently if a covering cap is arranged under the seat to hide the mechanism, a relatively high housing in the vertical direction must be provided, which may even have further bulges and convex curves.

It is an object of the invention to provide a chair of this generic type wherein the space beneath the seat required by the mechanism is as small as possible and whereby it is possible by using the same principle parts with only slight alterations and few additional parts to create different structural configurations, such as for example, a simple tiltable backrest, a backrest that can be fixed or immobilized in different rearward tilted positions, a backrest supported and adjustable by means of a gas spring, and the like.

To attain the above-mentioned object, a chair according to this invention is characterized by an angular holder for the backrest with an angle of approximately 120° between an upper portion and an offset arm of the backrest holder, the offset arm extending under a seat holder. At a distance from the junction between the offset arm and the upper portion of a backrest holder, the backrest holder is pivotally connected to a first pivoting axle arranged under the rear side of the seat holder. At the forward end of the offset arm, a second axle is arranged which connects the forward end with the chair stand of the chair. The upper portion of the backrest holder, with a mount for receiving the backrest, is offset rearwardly of the portion of offset arm forming the connection between the two axles. This offset is attained by widening or reinforcing the offset arm extending under the seating surface essentially in the forward direction.

The support frame of the seat holder is arranged stationarily in the horizontal plane. The first pivoting axle is placed fixedly under the rear edge of the seat holder. The second axle is supported in the chair stand so as to be displaceable on a pitch circle guide in the form of an arcuate slot. The center of which is the first pivoting axle. The second axle may be capable of being immobilized or fixed with respect to its pitch circle guide. For example, a clamping bolt may be arranged on an extension in the outward projection of the axle to apply a clamping effect against the guide.

According to a further example or embodiment, the support frame of the seat holder may be pivotally connected to a forward end of the chair stand frame to be rotatable in the vertical direction. A tie rod pivotally supported on the first axle under the rear edge of the stand has the form of a lamellar pack and extends to the second axle which is stationarily mounted on the stand. In this embodiment, the pivoting tie rod, together with the offset arm of the backrest support is guided in an elongated slot cooperating with the first axle at the connection between the seat holder and the offset arm. On the second axle, a second lamellar pack and a clamping bolt are provided for the compression of the lamellar pack of the tie rod. The second axle may be displaceable in an arcuate slot in the stand while fixedly connected with the pivoting rod and the backrest support. A lamellar pack fixedly mounted on the stand is interdigitated with the lamella of the tie rod.

According to another example or embodiment, the support frame of the seat holder is fixedly arranged in a horizontal plane. A tie rod is connected in parallel relationship with the offset arm of the backrest holder between the first and second axles and the second axle is supported stationarily in the stand as a pivoting axle. Both the offset arm and the tie rod are connected with the first axle by a lamellar pack and are adjusted by a clamping bolt arranged on the first axle. According to another example or embodiment, the support frame of the seat holder may be pivotally connected to a forward point on the chair stand frame so as to be pivotal in the vertical direction. A tie rod in the form of a lamellar pack connects the first axle to and is parallel to the offset arm. The second axle, as the pivoting axle, is stationarily mounted in the stand and both the tie rod and the offset arm overlap with an elongated slot in the first pivoting axle, upon which a lamellar pack engages the lamella of the tie rod so as to be fixedly positioned by means of a clamping bolt.

Accordingly to a further example or embodiment, the support frame of the seat holder may be pivoted around a forward pivotal connection with the chair stand direction and a gas spring is arranged approximately parallel with the offset arm of the backrest holder and is positioned between the second axle and the first axle. The offset arm includes an elongated slot receiving the first axle and actuating means are provided for the gas spring.

The upper arm of the backrest holder for the backrest for the backrest is tubular with a rectangular cross-section and equipped with a guide insert for a back rod. Beneath the guide insert, a clamping notch is arranged for the adjustment in height of the back rod. The guide insert is provided with a closing gap overlapping the upper end of the angled arm.

BRIEF DESCRIPTION OF THE DRAWINGS

The invention is explained herein below with reference to the drawings attached hereto. In the drawings:

FIG. 1*a* is a detail of the chair stand frame of the chair mechanism of FIG. 1.

FIG. 5*c* is a vertical section of the preferred embodiment of FIG. 5 at an inclined position;

FIG. 6*a* is a vertical section of the preferred embodiment of FIG. 6 at an inclined position.

DETAILED DESCRIPTION OF THE PREFERRED EMBODIMENTS

Figure 1:
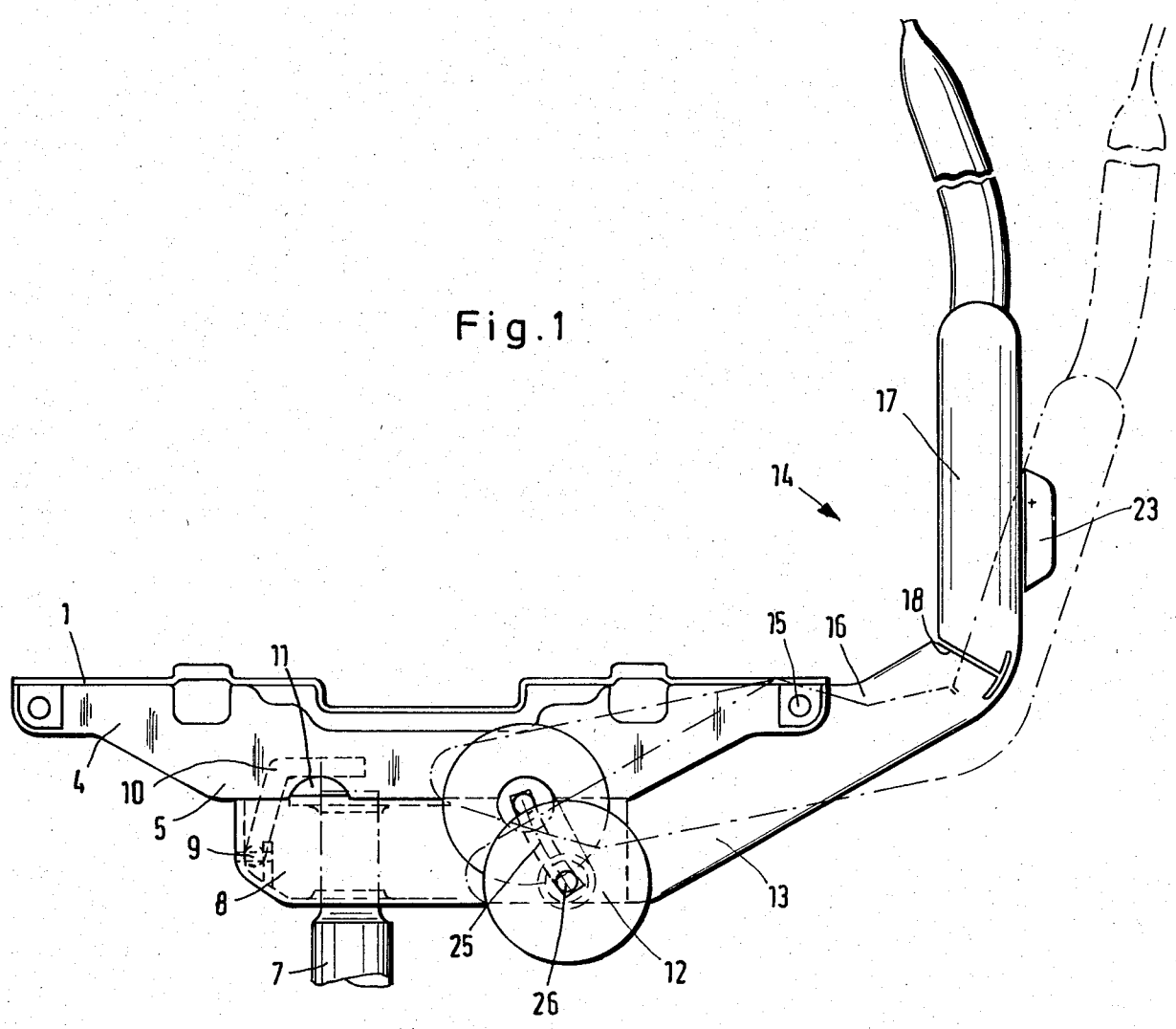
FIG. 1 is a vertical section through a chair mechanism in accordance with a first preferred embodiment of the present invention.

The stand for the seating surface preferably consists of a stamped steel sheet with an approximately hexagonal frame seat holder 1 and an intermediate plate 2 which connects to longitudinal beams 3 of the frame 1. A channel 4, approximately U-shaped in cross-section is parallel to the longitudinal beams 3 and substantially centrally positioned between the beams 3. The channel 4 is provided with downwardly extending flanges which have a center section 5 of greater width than end sections of the channel.

Close to the center, this U-shaped channel 4 has a transverse section 6 which serves as a connection point with the support post 7 of the swivel chair. Thus, underneath the section of greater width 5 of the downwardly extending flanges of the U-shaped channel 4, a substantially rectangular support element 8 is positioned under the U-shaped channel 4, so as to provide further bearing supports for the support post 7. A lever 9 is supported in a forward section of the substantially rectangular support element 8, and is provided with an angular extension 10 which acts on the upper end of the support post 7 and an actuating means 11 in the heel post 7 for a gas spring. This gas spring, now shown, controls the vertical displacement of the seat holder. The substantially rectangular support element 8 is provided with a downwardly facing open rear section. The lower front end portion 12 of a lower offset arm 13, which is angled in the downward direction from the backrest holder 14 is located therein. A bearing support and pivoting point 15 of the angled arm 14 is mounted around a horizontal axle at the rear end of the channel 4. The upper angled arm 17 is connected with the lower offset arm 13 by offset 16 extended in the direction of the lower offset arm 13. The dividing junction 18 between the two angled arms 13 and 17 is displaced to the rear by the offset arm portion 16.

Figure 6:
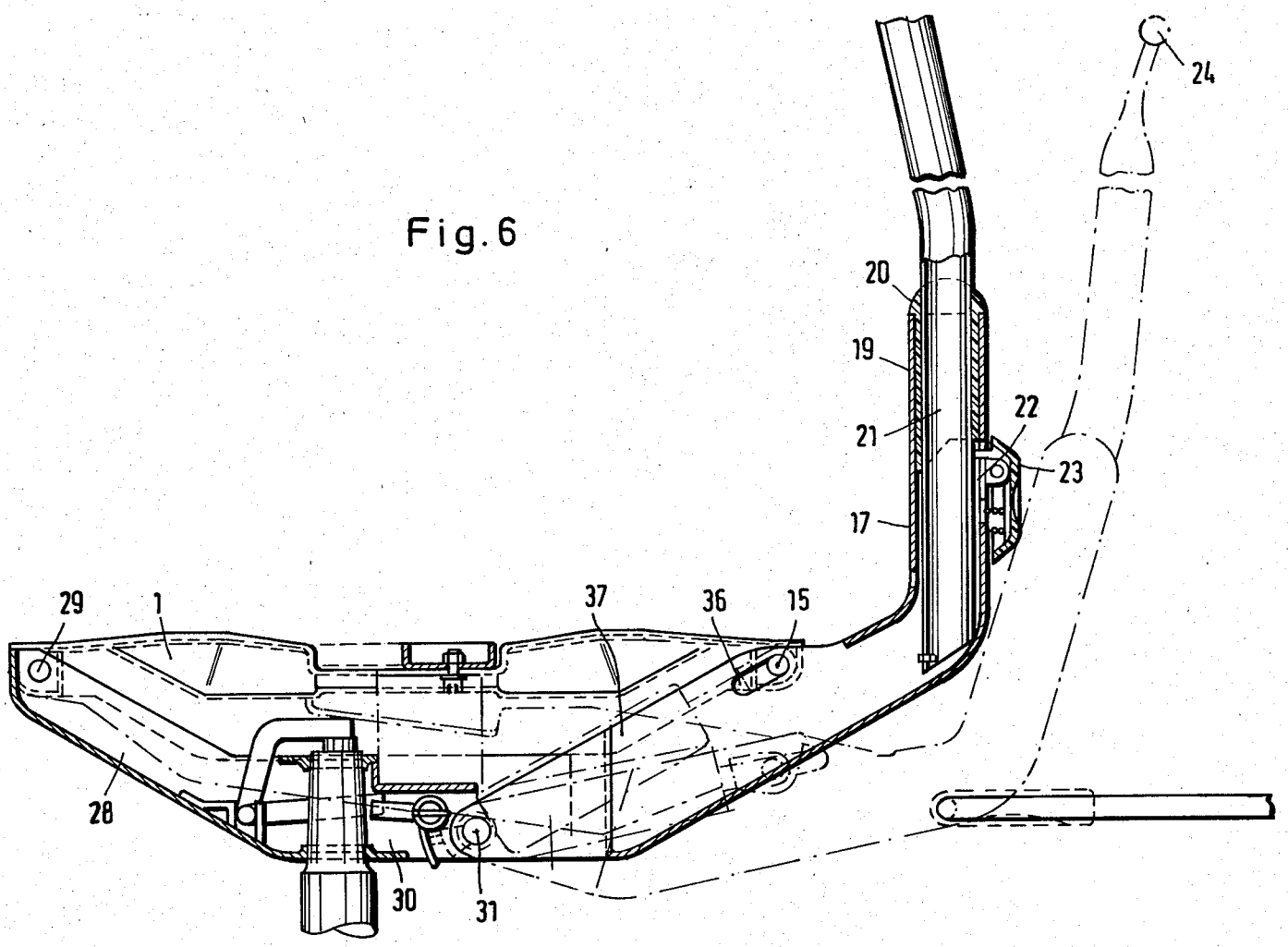
FIG. 6 is a vertical section through a third preferred embodiment of the present invention.

The upper angled arm 17 has a substantially rectangular cross-section which has a guide insert 19, made preferably of a synthetic plastic material, inserted from the top (FIG. 6). The guide insert 19 is provided at its upper end with an overlapping closure cap 20 which protrudes over the angled arm 17. A holding rod 21 of the backrest is inserted into the guide insert 19. On the rear side of the upper angled arm 17, there is an opening 22 on which a locking notch 23 is arranged for the adjustment of the backrest to a desired height. The backrest is positioned on the upper end of the rod 21 and a swivel hinge 24.

According to the first preferred embodiment corresponding to FIG. 1, the lower offset arm 13 cooperates at its forward end 12 with an elongated slot 25 extending along an arc for movement about the pivoting axle 15. The elongated slot 25 is associated with a threaded bolt 26 supported in the substantially rectangular support element 8 under the support frame of the seating surface in a horizontal plane and penetrating through the elongated slot 25 on both sides of the support element 8. The threaded bolt 26, on one side, is provided with threads to which a threaded handle 27 is screwed. Upon the release of this threaded bolt 26 by means of the threaded handle 27, the backrest holder 14 may be pivoted with the backrest into any desired position, defined by the extent of slot 25, and then fixedly positioned by tightening the threaded bolt 26 with the threaded handle 27. A compression return spring, not shown, arranged between the offset arm 13 of the upper arm 14 and the seat holder 1 serves to return the backrest holder 14 with the backrest holder into the upright vertical position. The desired position may be set after the release of the threaded handle 27 by the person seated on the chair leaning backward to an appropriate extent. The maximum extent of rearward tilt of the backrest holder 14 is shown by dash-dot lines in FIG. 1.

Figure 5B:
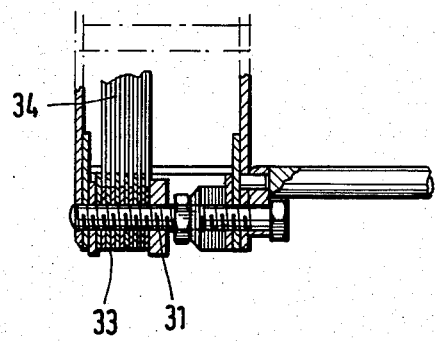
FIG. 5*b* is a detailed view of a connection in the chair mechanism of FIG. 5.
Figures 5, 5A:
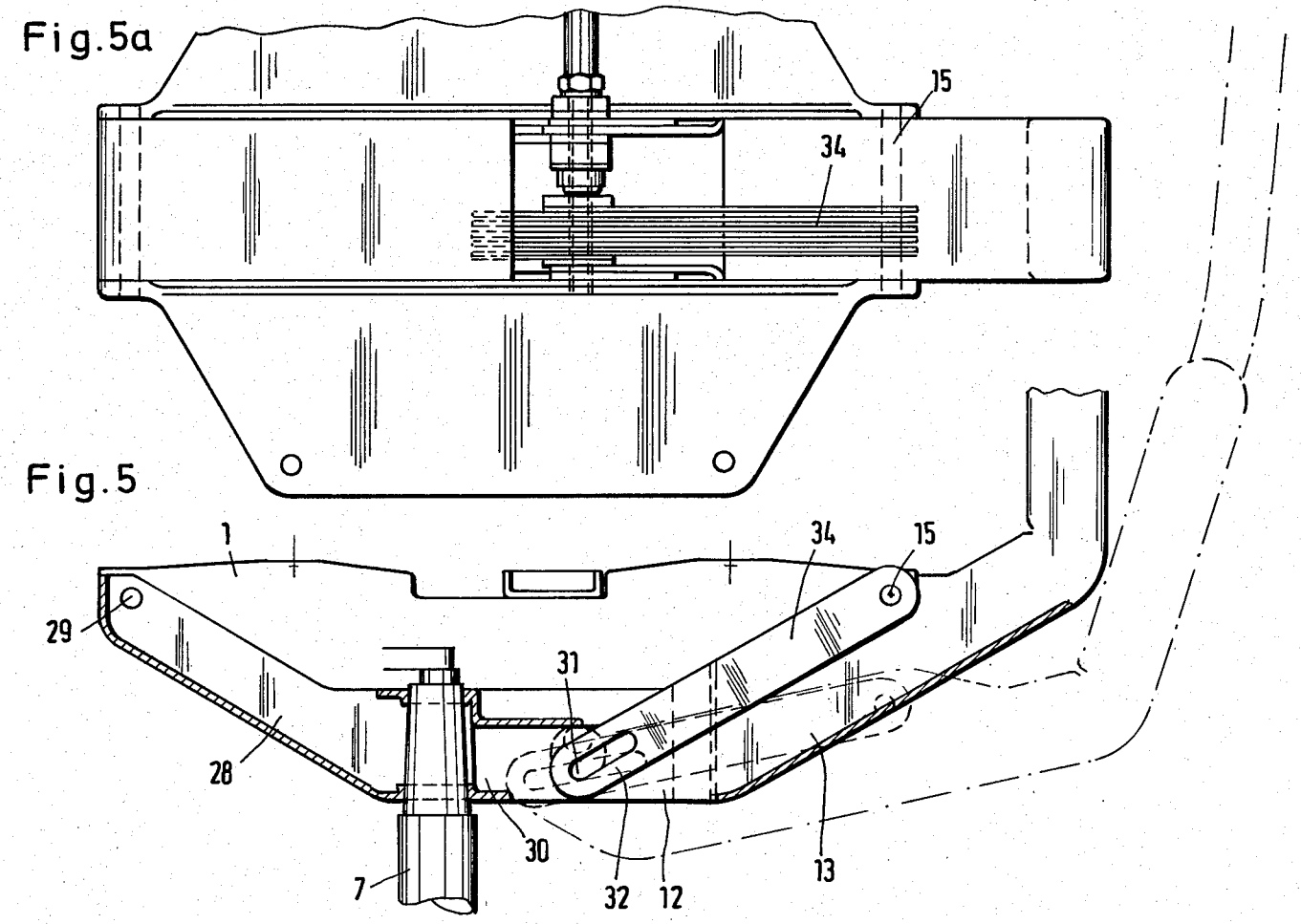
FIG. 5 is a vertical section through a second preferred embodiment of the present invention in an upright position.
FIG. 5*a* is a top view of the embodiment shown in FIG. 5.

According to a further example or embodiment, corresponding to FIG. 5, a chair stand frame 28, underneath the support frame, is supported on the support post 7. The seat holder 1 has an articulated connected to the chair stand frame 28 and may be swivelled in the vertical direction around a horizontal front pivot 29. The chair stand frame 28 extends past the support post 7 in an extension 30 provided with a horizontal clamping bolt 31. This clamping bolt 31 forms a pivoting and sliding guide for a lower front part 12 of the offset arm 13 of the the backrest holder 14. The part 12 is provided with an elongated slot for the threaded clamping bolt 31. A lamellar pack 33 is fixedly arranged in the front portion 30 of the lower frame 28 (FIG. **5*b*). A lamellar pack 34, interdigitated with the lamellar pack 33, is provided as a tie rod. The lamellar pack 34 is provided with an elongated slot 35 for the clamping bolt 31 and has an articulated connection at its opposite end to the shaft 15 located at the rear portion of the seat holder 1**.

As may be seen in FIGS. 5, **5*a* and 5*b*, by an appropriate adjustment of the clamping bolt 31, the two lamellar packs 33 and 34 are frictionally pressed against each other. The adjustment of the backrest holder 14, with the simultaneous tilting of the seat holder 1 may be effected while pivoting around the front axle 29** so that the desired position of the seating surface and the backrest may be fixedly positioned.

Figure 2:
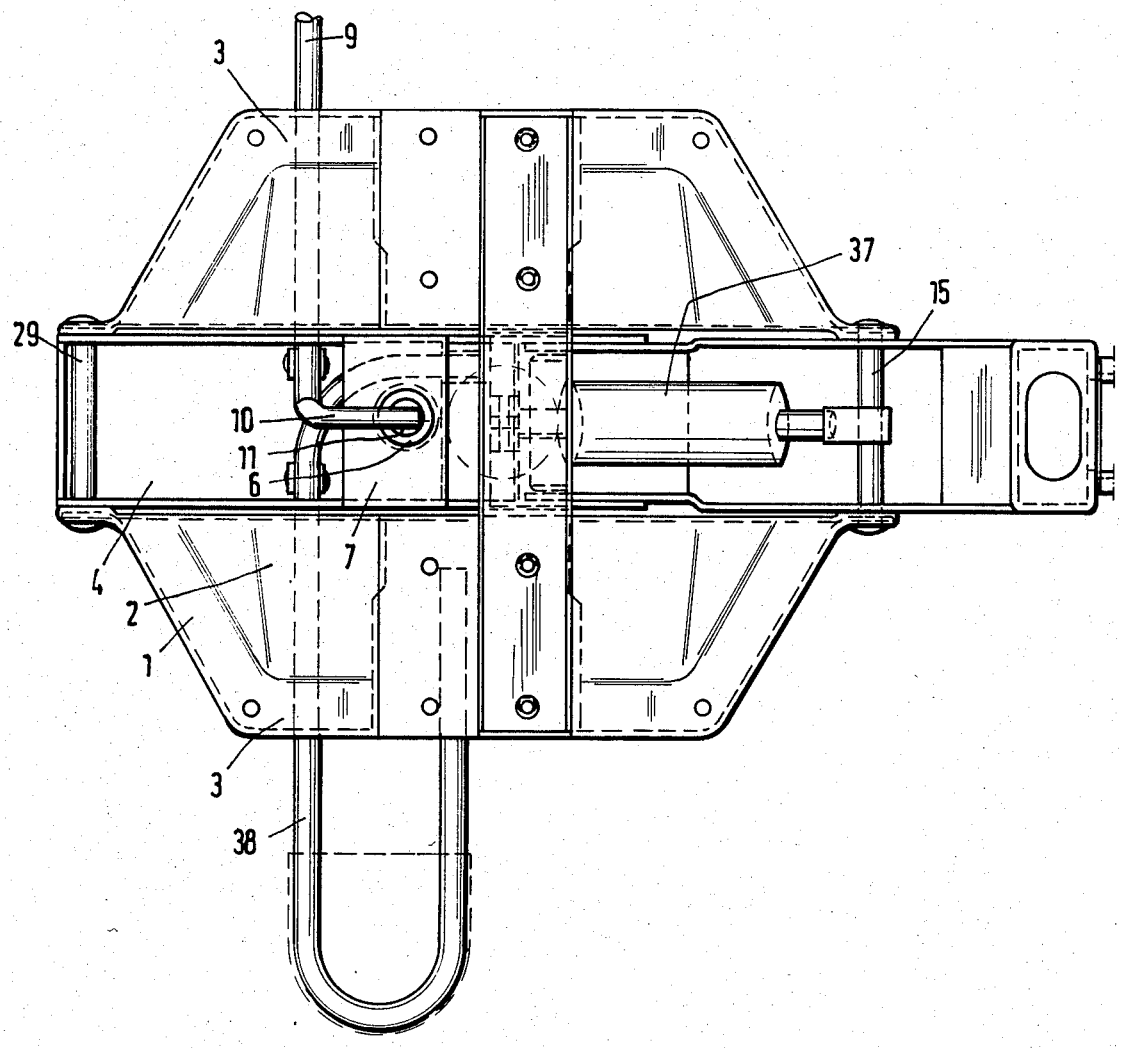
FIG. 2 is a top view of the mechanism of FIG. 1.
Figure 3:
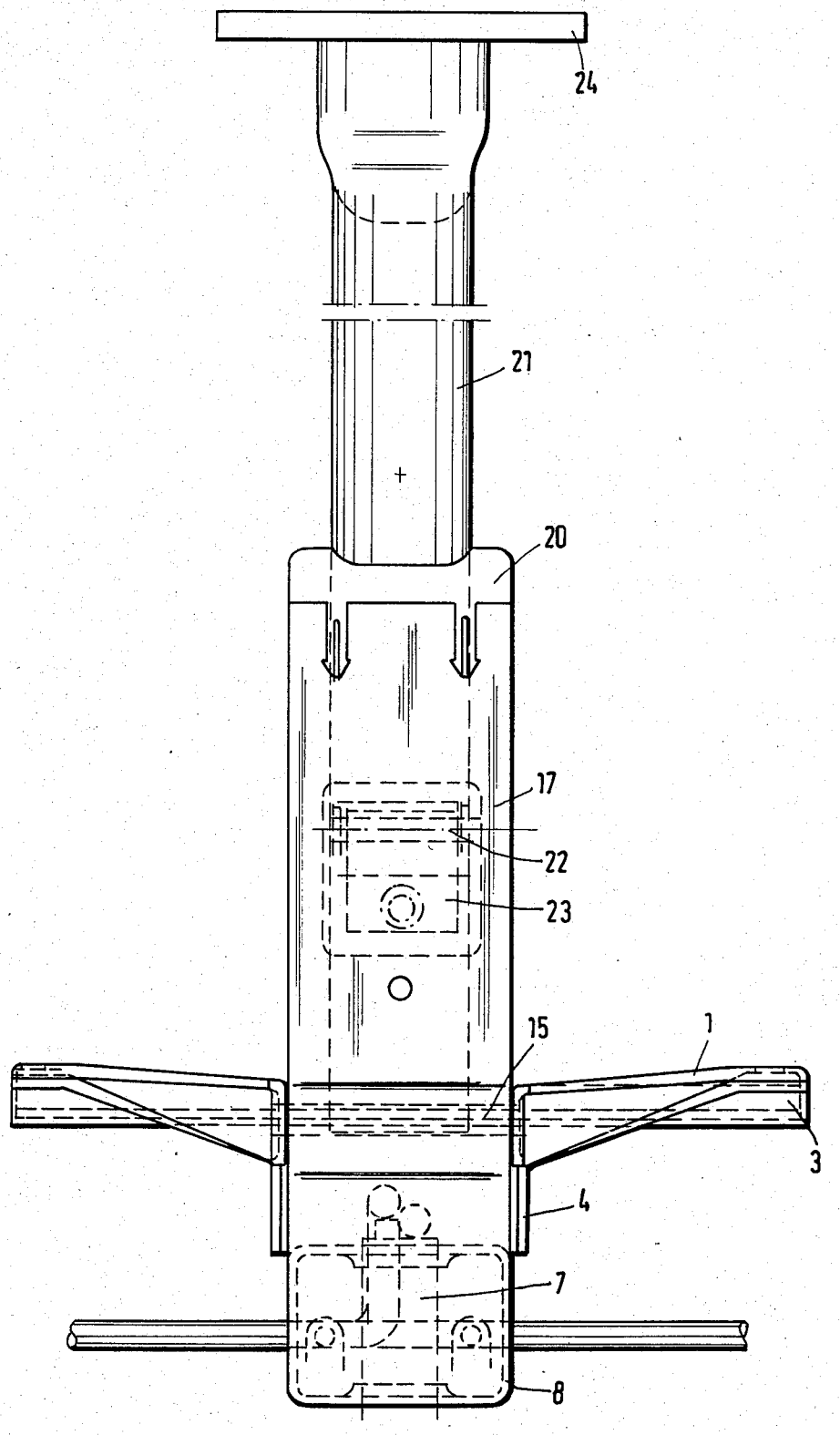
FIG. 3 is a side view of the backrest holder of the chair mechanism of FIG. 1.
Figure 4:
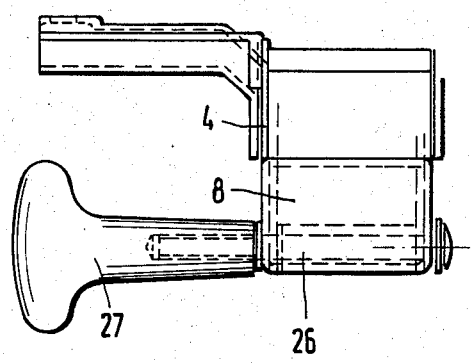
FIG. 4 is a detailed view of a fastening arrangement for the backrest holder of the mechanism of FIG. 1.

In a further example or embodiment according to FIG. 6 and with reference to FIG. 2, the configuration of the support frame 1 of the seating and the lower frame 28 is identical with that of the foregoing example or embodiment, wherein the support frame 1 may be pivoted around a front axle 29 and is thus adjustable in its tilted position. One end 36 of a gas spring 37 has an articulated connection to the rear pivot axle 15 on the seat holder 1. The other end 36 has an articulated connection with a chair stand axle 31 in the extension 30 of the lower frame 28. The gas spring 37 may be activated by means of a actuating element 38 (FIG. 2). As is seen from the dash-dot lines in FIG. 6, there is again a seat holder 1 and the angle of the holder of the backrest may be adjusted and fixedly positioned independently of each other.

The principles, preferred embodiments and modes of operation of the present invention have been described in the foregoing specification. The invention which is intended to be protected herein should not, however, be construed as limited to the particular forms disclosed, as these are to be recognized as illustrative rather than restrictive. Variations and changes may be made by those skilled in the art without departing from the spirit of the present invention. Accordingly, the foregoing detailed description should be considered exemplary in nature and not as limiting to the scope and spirit of the invention as set forth in the appended claims.

What is claimed is:

1. A chair mechanism comprising:

a chair stand assembly including a chair stand frame with a front end portion;

a seat holder with a forward portion;

a first pivotal connection between said forward portion of said seat holder and said front end portion of said chair stand frame, whereby said seat holder may pivot about a horizontal axis;

a backrest holder including an offset arm and a second portion coupled at an obtuse angle with the offset arm;

a second pivotal connection between a forward end portion of said offset arm and said chair stand frame, said second pivotal connection spaced rearwardly of said first pivotal connection, whereby said backrest holder may pivot relative to said chair stand frame about a second horizontal axis;

a third connection connecting said offset arm to a rear portion of said seat holder comprising a horizontally disposed pivot member affixed to one of said offset arm and said rear portion of the seat holder and a slot in the other of said offset arm and said rear portion, said slot receiving said pivot member, said slot extending in a linear direction defined through said second and third connections, whereby said pivot member may move in said slot so as to permit pivoting of said seat holder about said first pivotal connection simultaneously with pivoting of said backrest holder about said second pivotal connection;

means for selectively arresting movement of said pivot member in said slot, said selectively arresting means arranged between said second connection and said pivot member of the third connection so to fix the distance therebetween.

2. The chair mechanism according to claim 1 wherein said second portion is offset rearwardly of a portion of said offset arm between said second and third connections.

3. The chair mechanism according to claim 1, wherein said arresting means includes a tie rod in the form of a lamellar pack extending from said pivot member of the third connection to the second connection, said tie rod including a longitudinal slot for receiving a clamping bolt at said second connection, said clamping bolt adapted to compress said lamellar pack.

4. The chair mechanism according to claim 3, wherein said chair stand frame includes an arcuate slot at said second connection and said second connection includes means for selectively positioning said clamping bolt at locations in said arcuate slot, whereby the position of the second connection may be adjusted when the second connections is fixedly connected with said third connection by the tie rod.

5. The chair mechanism of claim 3, wherein said second pivotal connection includes a second lamellar pack interdigitated with said lamellar pack of said tie rod.

6. The chair according to claim 1 wherein said arresting means includes a gas spring arranged between said second connection and said pivot member of the third connection.

7. The chair mechanism according to claim 1, wherein said upper portion of the backrest holder is tubular with a rectangular cross-section said upper portion including a guide insert for receiving a backrest rod and clamping notch means for adjusting the height of the backrest rod.

8. The chair according to claim 7, wherein the guide insert is equipped with a round closing cap overlapping the upper end of the angled arm.

9. The chair mechanism of claim 1, wherein said pivot member is fixed relative to said rear portion of the seat holder and said slot is in said offset arm at a location spaced from the coupling with said second portion.

10. The chair mechanism of claim 9, wherein said offset arm and second portion are coupled at approximately 120°, said offset arm extending obliquely beneath said seat holder.

11. The chair mechanism of claim 10, wherein said first and second pivotal connections are at a fixed locations on said chair stand frame.

12. The chair mechanism of claim 11, wherein said second pivotal connection is at a position intermediate of said first and third connections.

* * * * *